US008109789B2

(12) United States Patent
Tyler

(10) Patent No.: US 8,109,789 B2
(45) Date of Patent: Feb. 7, 2012

(54) CONNECTOR ASSEMBLY WITH STRAIN RELIEF

(75) Inventor: Adam Price Tyler, Rochester Hills, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/635,476

(22) Filed: Dec. 10, 2009

(65) Prior Publication Data

US 2010/0151721 A1 Jun. 17, 2010

Related U.S. Application Data

(60) Provisional application No. 61/201,606, filed on Dec. 12, 2008.

(51) Int. Cl.
*H01R 13/40* (2006.01)

(52) U.S. Cl. ..... 439/587

(58) Field of Classification Search ..... 439/587, 439/589, 460, 462, 607.47, 607.48, 607.51
See application file for complete search history.

(56) References Cited

U.S. PATENT DOCUMENTS

| | | | | |
|---|---|---|---|---|
| 3,218,413 | A | 11/1965 | Poehlman, Jr. | |
| 3,320,383 | A | 5/1967 | Koetter | |
| 3,924,914 | A | 12/1975 | Banner | |
| 4,178,061 | A | 12/1979 | Ahroni | |
| 4,408,822 | A | 10/1983 | Nikitas | |
| 4,426,127 | A | 1/1984 | Kubota | |
| 4,575,704 | A | 3/1986 | Pezold | |
| 4,790,768 | A * | 12/1988 | Domingues | 439/320 |
| 5,137,473 | A | 8/1992 | Nickola | |
| 5,562,497 | A * | 10/1996 | Yagi et al. | 439/607.47 |
| 6,010,348 | A | 1/2000 | Alden | |
| 7,407,412 | B2 * | 8/2008 | Khemakhem | 439/578 |
| 2003/0001715 | A1 | 1/2003 | Montague | |
| 2004/0224552 | A1 * | 11/2004 | Hagmann et al. | 439/461 |

FOREIGN PATENT DOCUMENTS

| | | |
|---|---|---|
| DE | 19727453 | 1/1999 |
| DE | 100 11 341 | 9/2001 |
| GB | 2284510 | 6/1995 |
| GB | 2 448 595 | 10/2008 |

OTHER PUBLICATIONS

International Search Report, International Application No. PCT/US2009/006519, International Filing Date Nov. 12, 2009.

* cited by examiner

*Primary Examiner* — Phuong Dinh

(57) ABSTRACT

A connector assembly includes an outer housing, an inner housing, a collet, and a retainer. The outer housing longitudinally extends between a front end and a rear end. The rear end has an opening for receiving a cable. The inner housing is located within the outer housing and includes a shield that is electrically coupled with the cable to restrict emission of electromagnetic interference. The collet is disposed around the cable at the rear end of the outer housing. The collet includes longitudinally extending fingers that are configured to engage the cable. The retainer is secured to the rear end of the outer housing and secures the collet between the outer housing and the retainer. The retainer and the collet redirect strain imparted on the cable away from an interface between the shield and the cable.

20 Claims, 9 Drawing Sheets

CONNECTOR ASSEMBLY WITH STRAIN RELIEF

CROSS-REFERENCE TO RELATED APPLICATIONS

This application relates to and claims priority benefit to co-pending U.S. Provisional Application No. 61/201,606, filed Dec. 12, 2008, and entitled "Shielded Connector Assembly With Strain Relief" (the "'606 Application"). The entire disclosure of the '606 Application is incorporated by reference herein in its entirety.

BACKGROUND OF THE INVENTION

The present invention relates to shielded connector, and more particularly to a shielded connector having a strain relief for use in high voltage applications.

Increased fuel costs and increased efforts at reducing environmental pollution have lead the automotive industry towards electric and hybrid electric vehicles (HEV). One design aspect of these vehicles is the consideration or requirements for a relatively high operating voltage. Consequently, specific components of some such known vehicles are designed to accommodate high operating voltages.

In some current automotive industry applications, a high voltage shielded connector is used to provide a stable, sealed mechanical and electrical connection between a high voltage plug connector and a header connector mounted to a metallic module. The connector may need to provide robust shielding continuity from a braided cable shield of an incoming multicore cable that supplies high voltage current to the shield on the plug connector. For example, the connector may need to ensure an electrically conductive pathway that is continuous between an incoming cable and a shield within the connector in order to provide shielding from electromagnetic interference.

One problem with known connectors is that the stiffness of the cable may transmit a high degree of tensile, bending, and torsional strain into the electrical interconnection between the braided cable shield and the plug shield component. For example, the movement of the cable outside of the connector may impart significant strain at interfaces between the cable and one or more components of the connector. The strain may result in separation of the cable from the components at the interfaces and thereby jeopardize the mechanical and electrical performance of the connector.

BRIEF DESCRIPTION OF THE INVENTION

In one embodiment, a connector assembly is provided. The connector assembly includes an outer housing, an inner housing, a collet, and a retainer. The outer housing longitudinally extends between a front end and a rear end. The rear end has an opening for receiving a cable. The inner housing is located within the outer housing and includes a shield that is electrically coupled with the cable to restrict emission of electromagnetic interference. The collet is disposed around the cable at the rear end of the outer housing. The collet includes longitudinally extending fingers that are configured to engage the cable. The retainer is secured to the rear end of the outer housing and secures the collet between the outer housing and the retainer. The retainer and the collet redirect strain imparted on the cable away from an interface between the shield and the cable.

In another embodiment, another connector assembly is provided. The connector assembly includes an outer housing subassembly, a cable, a collet and a retainer. The outer housing subassembly extends between a front end and a rear end. The cable extends from the rear end of the outer housing subassembly. The collet is affixed to the cable at the rear end of the outer housing subassembly and has an opening through which the cable extends. The retainer surrounds the collet and is secured to the outer housing subassembly. The collet and the retainer reduce strain imparted on the cable.

DETAILED DESCRIPTION OF THE INVENTION

Figure 1:
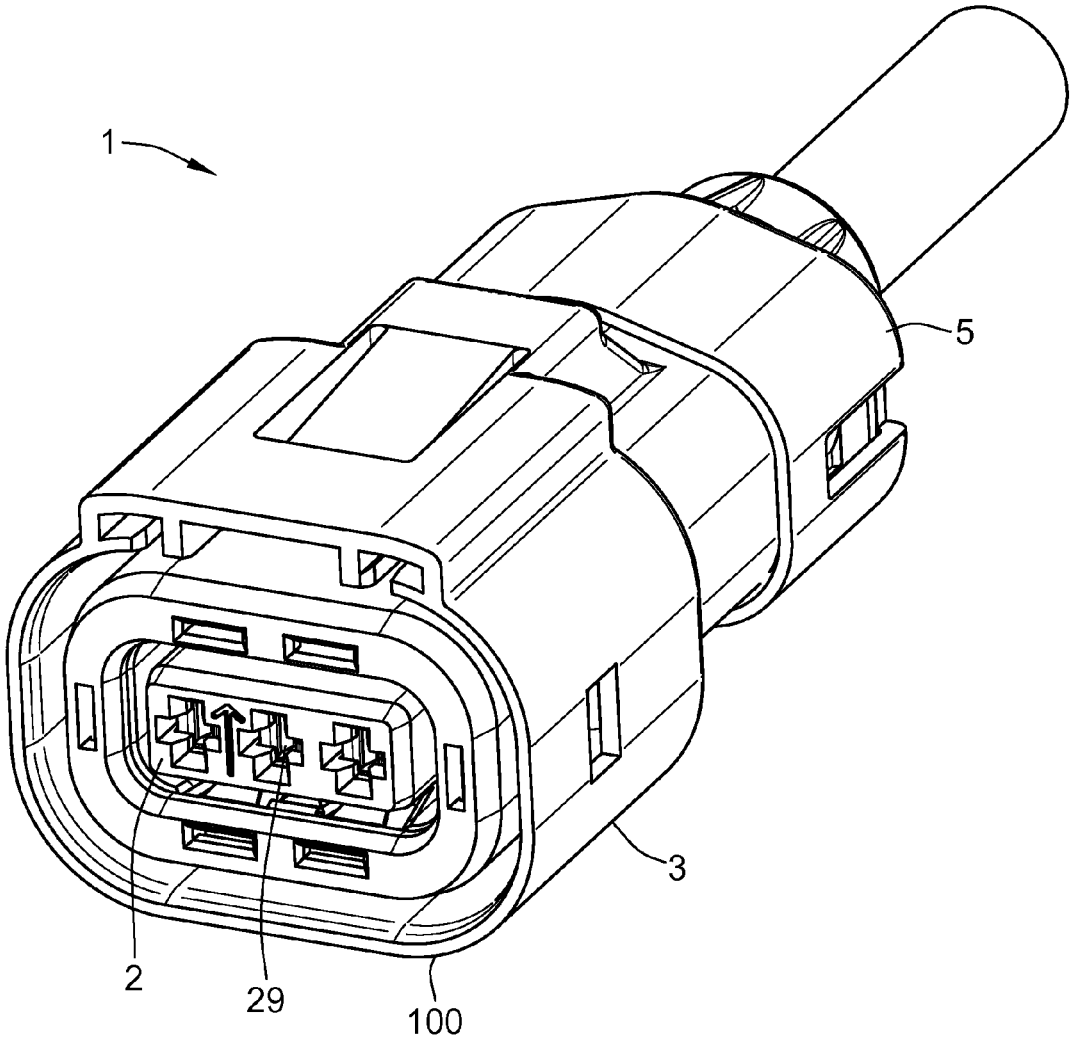
FIG. 1 is a front perspective view of a connector assembly in accordance with one embodiment of the present disclosure.
Figure 2:
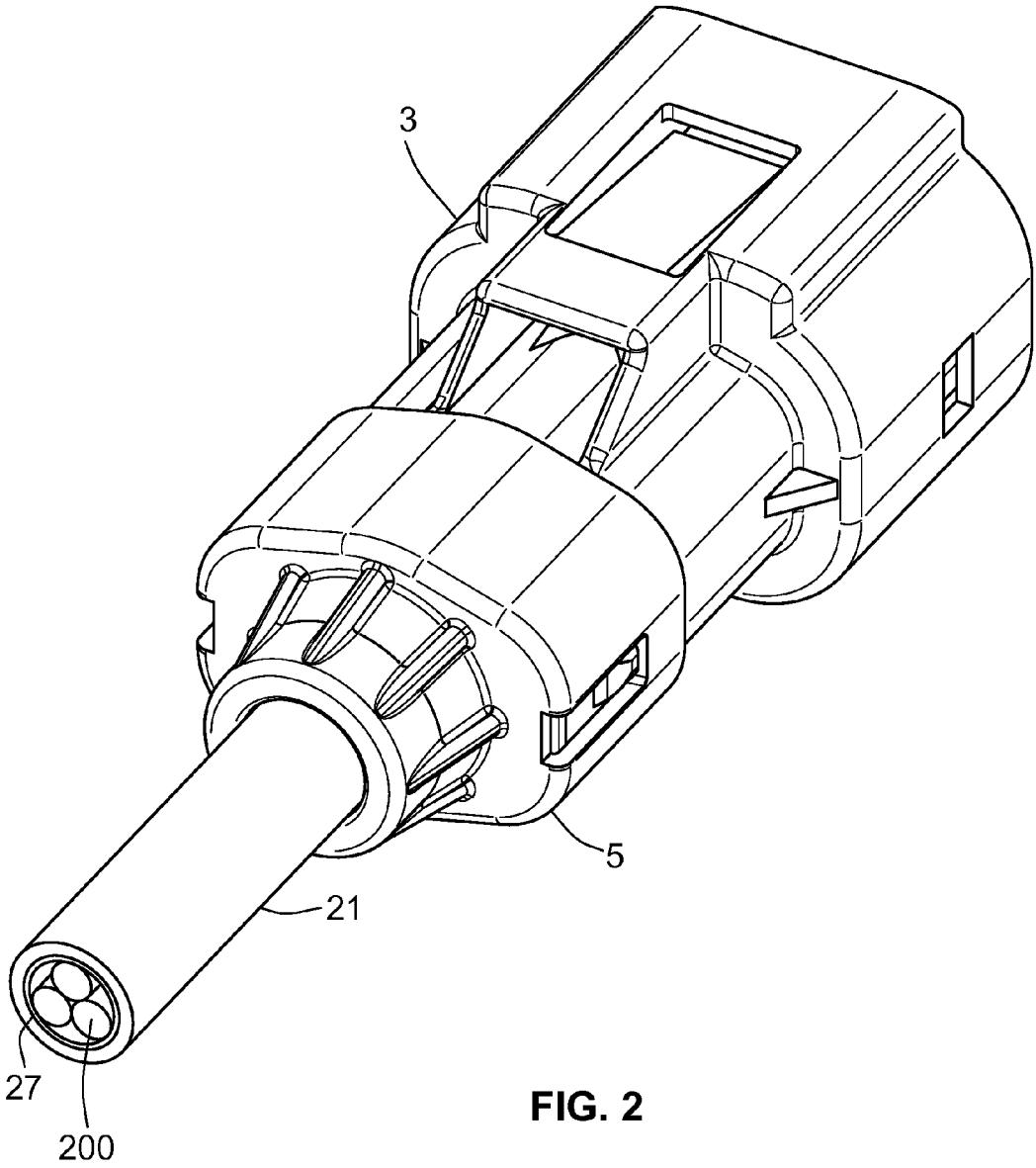
FIG. 2 is a rear perspective view of the connector assembly shown in FIG. 1.
Figure 3:
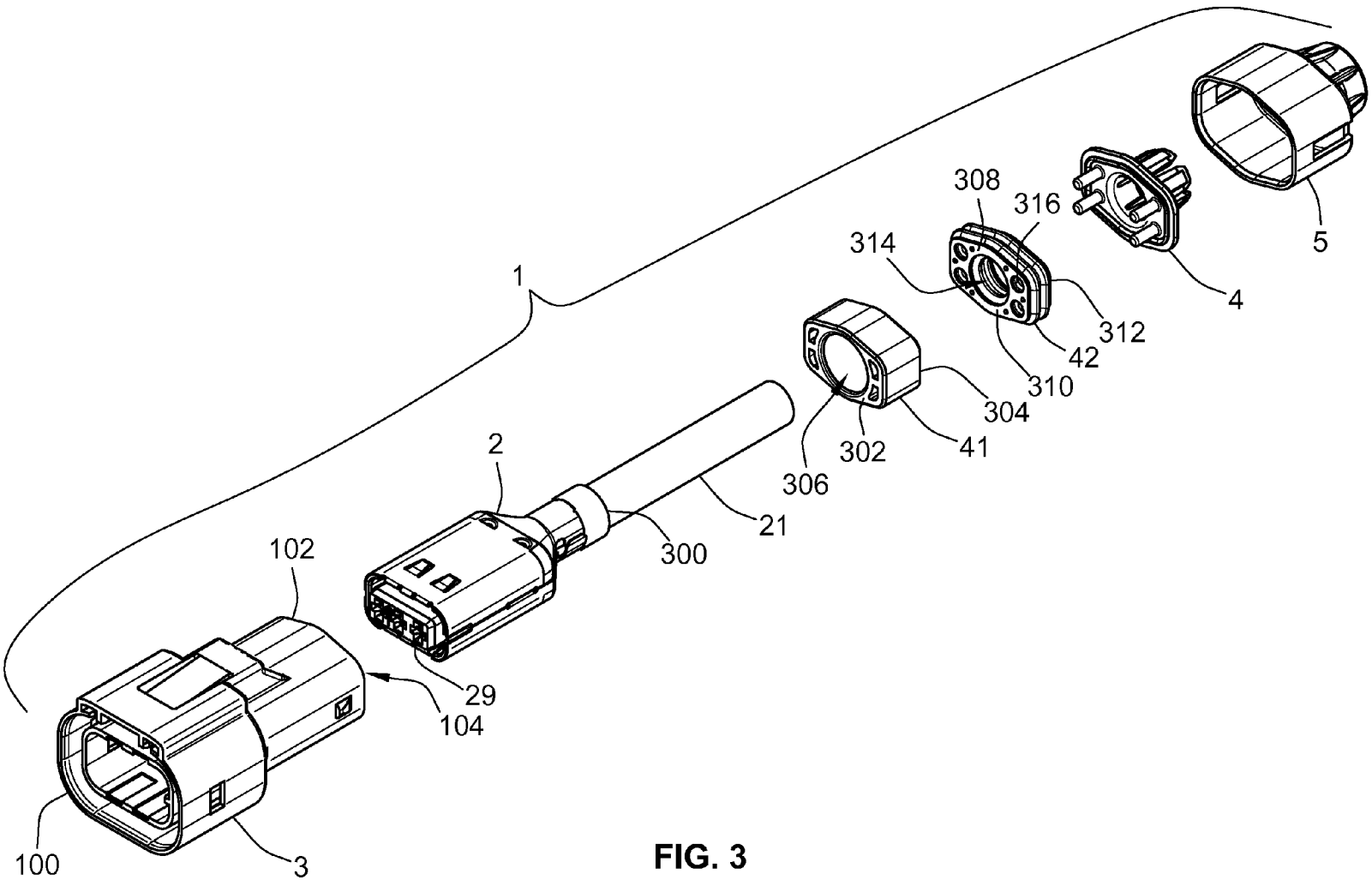
FIG. 3 is an exploded view of a partially assembled connector assembly shown in FIG. 1.

FIG. 1 is a front perspective view of a shielded connector assembly 1 in accordance with one embodiment of the present disclosure. FIG. 2 is a rear perspective view of the connector assembly shown in FIG. 1. FIG. 3 is an exploded perspective view of a partially assembled connector assembly 1 of FIG. 1. The connector assembly 1 may mate with a header connector such as the header connector subassembly disclosed in co-pending U.S. patent application Ser. No. 12/539,261, filed Aug. 11, 2009, and entitled "Connector Assembly With Two Stage Latch." The entire disclosure of the '261 Application is incorporated by reference herein. The connector assembly 1 and the header connector may mate with one another to transfer power therebetween. The connector assembly 1 may be a high voltage connector assembly. For example, the connector assembly 1 may be capable of transferring electric current with a header connector assembly at a voltage up to approximately 600 volts. The connector assembly 1 may transfer current at voltages of at least approximately 42 volts. Alternatively, the connector assembly 1 may be an assembly that transfers electric current at a lesser voltage. The connector assembly 1 may be a vehicular connector assembly. For example, the connector assembly 1 may be used to transfer electric current between two or more electronic devices or modules in an automobile. The header connector may be mounted to a module such as a metallic module (not shown) in an automotive high voltage application.

The connector assembly 1 includes an inner housing subassembly 2, an outer housing subassembly 3, a spacer 41 (shown in FIG. 3), a cable seal 42 (shown in FIG. 3), a collet 4 (shown in FIG. 3), and a retainer 5. The outer housing subassembly 3 longitudinally extends between a front end 100 and a rear end 102 (shown in FIG. 3). The front end 100 mates with a mating connector, such as a header connector (not shown). The rear end 102 includes an opening 104 that extends through the outer housing subassembly 3.

The spacer 41 is a body that is located in the interior of the outer housing subassembly 3. The spacer 41 is located between shields 23, 24 (shown in FIG. 4) of the inner housing subassembly 2 and the cable seal 42. The spacer 41 extends between opposite sides 302, 304 with an opening 306 extending therethrough. The opening 306 is sized or dimensioned to receive a cable 21 so that the cable 21 of the inner housing subassembly 2 may pass through the spacer 41. The spacer 41 may provide a positive forward stop in the outer housing subassembly 3 for the cable seal 42. For example, the spacer 41 may engage the cable seal 42 when the cable seal 42 is loaded into the outer housing subassembly 3 to limit how far the cable seal 42 may be displaced into the outer housing subassembly 3.

The cable seal 42 includes an elastomeric body 308 that is disposed between the spacer 41 and the collet 4. The cable seal 42 may provide a seal against the ingress of moisture and other contaminants into the interior of the outer housing subassembly 3 through the rear end 102 of the outer housing subassembly 3. The body 308 extends between opposite sides 310, 312 with a cable opening 314 extending therethrough. The cable 21 of the inner housing subassembly 2 may pass through the cable seal 42 through the cable opening 314. One or more post openings 316 may extend through the body 308. In the illustrated embodiment, the post openings 316 are spaced around the periphery of the cable opening 314, although a different number and/or arrangement of the post openings 316 may be provided than what is shown in FIG. 3.

Figure 4:
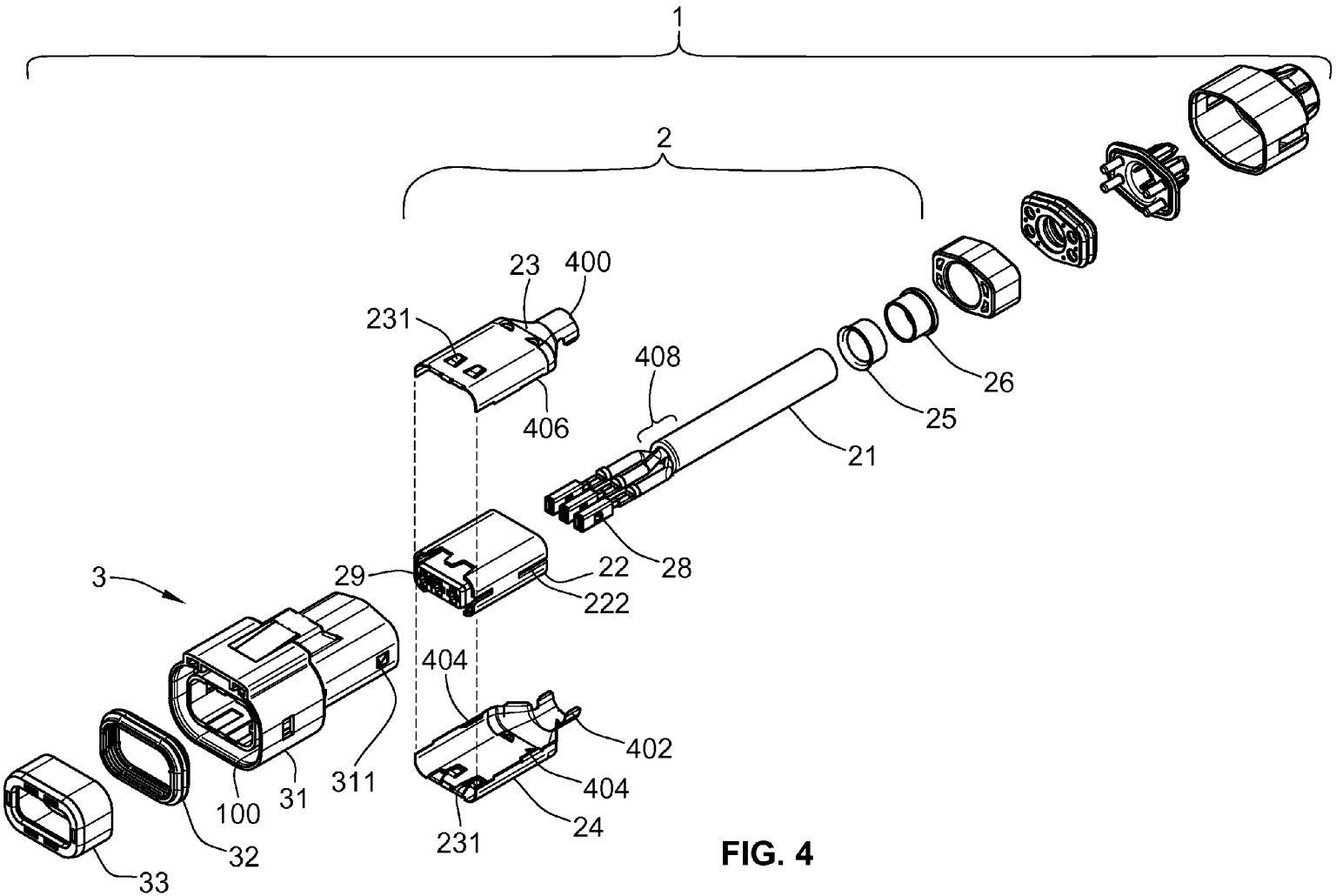
FIG. 4 is an exploded view of the connector assembly shown in FIG. 1.

FIG. 4 is an exploded view of the connector assembly 1 of FIG. 1. The inner housing subassembly 2 includes an inner housing 22, the upper shield 23, the lower shield 24, the cable 21, an inner ferrule 25, and an outer ferrule 26. The inner housing 22 is located between the shields 23, 24. The inner housing 22 may include, or be formed from, a dielectric material. For example, the inner housing 22 may be molded from one or more polymers. The shields 23, 24 may be electromagnetic shields that shield one or more components of the connector assembly 1 from electromagnetic interference. For example, the shields 23, 24 may restrict emission of electromagnetic interference outside of the shields 23, 24. The shields 23, 24 include one or more contact springs 231 that outwardly extend from the shields 23, 24. For example, the springs 231 may be cantilevered beams that are biased toward the shields 23, 24 when the connector assembly 1 is loaded into a header connector assembly. In one embodiment, the springs 231 engage the header connector assembly to electrically couple the shields 23, 24 with the header connector assembly, such as with a shield of the header connector assembly. The shields 23, 24 combine to form an electromagnetic shield that substantially encloses the inner housing 22. Alternatively, the shields 23, 24 may be provided as a single, unitary body formed from a conductive material, such as a metal or metal alloy. The inner housing 22 also includes slots 222 to provide temporary retention of the upper shield 23 and lower shield 24 prior to the installation of the inner housing subassembly 2 into the outer housing subassembly 3. For example, the shields 23, 24 may include inwardly protruding ridges 404, 406 that are received in the slots 222 to secure the shields 23, 24 to the inner housing 22.

The shields 23, 24 have rear openings 400, 402 (shown in FIG. 4) that form an opening 300 (shown in FIG. 3) when the shields 23, 24 are coupled to the inner housing 22. The cable 21 is inserted through the opening 300 defined by the rear openings 400, 402. The cable 21 includes one or more inner cores 200 (shown in FIG. 2) that longitudinally extend through the cable 21. The cores 200 may be wires capable of transmitting electric power. In the illustrated embodiment, the cable 21 is a multicore cable with a braided cable shield 27 (shown in FIG. 2). Each of the inner cores 200 is terminated with a terminal 28 crimped around the end of the corresponding inner core 200. The inner housing 22 comprises cavities 29 (shown in FIG. 1) for accommodating the terminals 28. The cavities 29 may receive contacts or terminals (not shown) of the header connector (not shown) with which the connector assembly 1 mates to electrically couple the header connector and the connector assembly 1.

As further shown in FIG. 4, the outer housing subassembly 3 comprises an outer housing 31, a peripheral seal 32, and a peripheral seal retainer 33. The outer housing 31 comprises a generally cylindrical body for accepting the inner housing subassembly 2. The outer housing 31 includes one or more outwardly protruding lugs 311 located on the outer surface of the outer housing 31. The peripheral seal 32 extends around the outer perimeter of the opening in the outer housing 31 at the front end 100. The peripheral seal 32 may be an elastomeric body that is compressed between the front end 100 of the outer housing 31 and the peripheral seal retainer 33. The peripheral seal retainer 33 may be joined to the outer housing 31 to secure the peripheral seal 32 in the front end 100 of the outer housing 31. The peripheral seal 32 may prevent ingress of moisture and other contaminants into the interior of the outer housing 31.

The inner and outer ferrules 25, 26 may include, or be formed from, a conductive material, such as a metal or metal alloy. The inner ferrule 25 may be placed over the cable 21 such that the cable 21 extends through the inner ferrule 25. The inner ferrule 25 may be placed over an exposed portion 408 of the braided cable shield 27. The outer ferrule 26 is placed over the inner ferrule 25 and may be crimped onto the shields 23, 24 at or proximate to the rear openings 400, 402. The inner ferrule 25 and outer ferrule 26 may mechanically couple and secure the shields 23, 24 with the cable shield 27. Alternatively, the outer and/or inner ferrules 26, 25 may provide an electrically conductive path between the shields 23, 24 and the cable shield 27. For example, the inner ferrule 25 may be electrically coupled to the cable shield 27 with the outer ferrule 26 being electrically coupled with the shields 23, 24. The cable shield 27 may be electrically joined with an electric ground reference to electrically couple the shields 23, 24 with the electric ground reference via the ferrules 25, 25. The shields 23, 24 may shield the inner housing 22 from electromagnetic interference via this electric coupling with the electric ground reference. As described herein, movement of the cable 21 may impart stress in connections between the cable shield 27 and one or more of the shields 23, 24 and/or may separate the shields 23, 24 from one another. The collet 4 may be secured to the cable 21 outside of the coupling of the cable shield 27 with the shields 23, 24 to prevent such stresses from separating the cable shield 27 from the shields 23, 24 and/or to prevent the shields 23, 24 from moving, separating, or breaking apart from one another.

Figure 6:
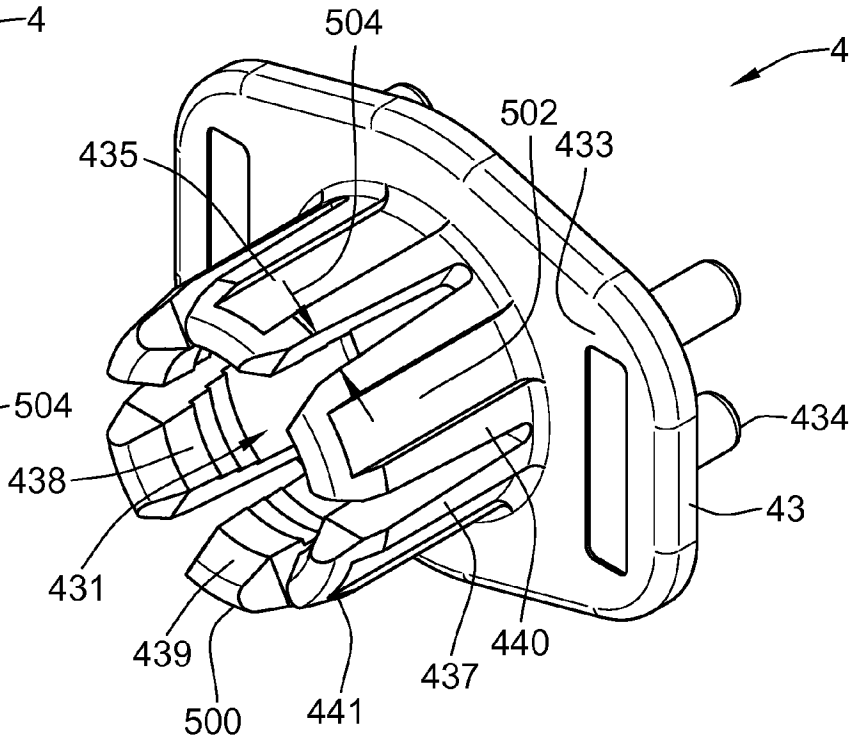
FIG. 6 is a rear perspective view of the collet shown in FIG. 5.
Figure 5:
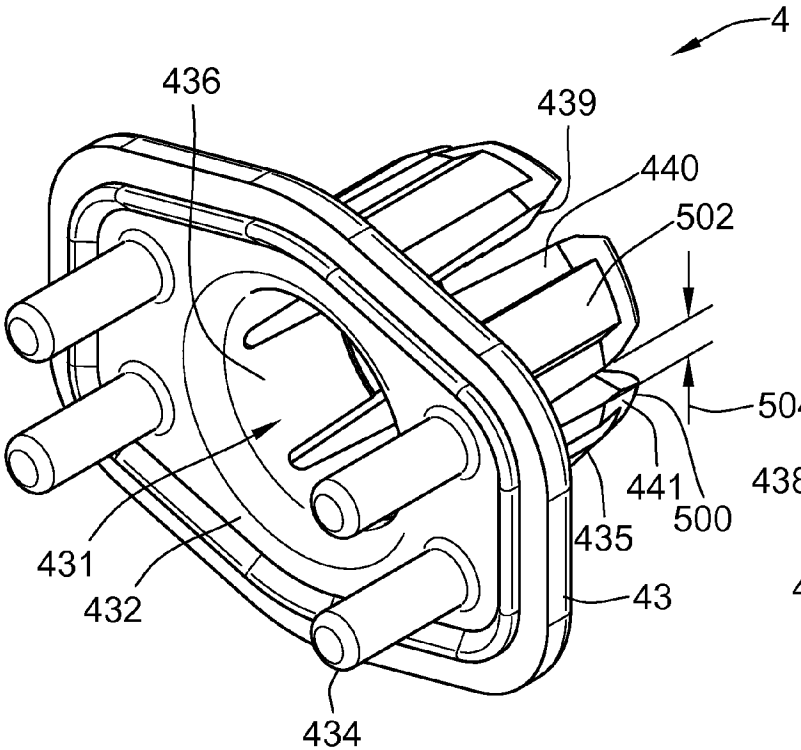
FIG. 5 is a front perspective view of a collet for the connector assembly shown in FIG. 1 in accordance with one embodiment of the present disclosure.

FIG. 5 is a front perspective view of the collet 4 and FIG. 6 is a rear perspective view of the collet 4 in accordance with one embodiment of the present disclosure. The collet 4 includes a planar body 43 having a central opening 431 extending therethrough. The body 43 is planar in that the thickness of the body 43 is significantly smaller than the dimensions of the body 43 in at least two other directions that are perpendicular to the thickness of the body 43. The thickness of the body 43 extends between a front side 432 and a rear side 433. When assembled to the outer housing subassembly 3 (shown in FIG. 1), the front side 432 of the collet 4 faces the interior of the outer housing 31 (shown in FIG. 4) while the rear side 433 faces away from the interior of the outer housing 31.

The body 43 is sized and shaped to coordinate with the spacer 41 (shown in FIG. 3), the cable seal 42 (shown in FIG. 3), and the retainer 5 (shown in FIG. 2). For example, the body 43 may enclose the spacer 41 and the cable seal 42 within the outer housing 31 (shown in FIG. 3) while fitting between the retainer 5 and the outer housing 31. One or more posts 434 extend from the front side 432. The posts 434 forwardly protrude from the front side 432 toward the interior of the outer housing 31 when the collet 4 is assembled to the outer housing 31. The posts 434 may be sized, shaped and located to fit in corresponding ones of the post openings 316 (shown in FIG. 3) of the cable seal 42 (shown in FIG. 3). The posts 434 may be received in the post openings 316 to orient and align the collet 4 with respect to the cable seal 42. Additionally, the posts 434 may be received into the post openings 316 to ensure that the collet 4 is positioned relative to the cable seal 42 such that the cable seal 42 is approximately evenly compressed by the collet 4 when the connector assembly 1 is assembled. Alternatively, different components may be used to orient and/or align the collet 4 with respect to the cable seal 42. For example, a different type of projection such as a protrusion, nub, or other extension may be used in place of or in addition to the posts 434.

One or more fingers 435 rearwardly extend from the rear side 433. The fingers 435 are located around the periphery of the opening 431. In the illustrated embodiment, the fingers 435 are flexible cantilevered beams that extend from the body 43 to corresponding outer ends 500. The fingers 435 may flex inward toward one another and outward away from one another. For example, the fingers 435 may outwardly flex away from one another to fit over the exterior or outer jacket of the cable 21 (shown in FIG. 3) when the when the collet 4 is installed over the cable 21.

The fingers 435 include inner surfaces 436 (shown in FIG. 5) and opposite outer surfaces 437 (shown in FIG. 6). In the illustrated embodiment, the inner surfaces 436 are serrated. For example, the inner surfaces 436 may include serrated or stair-step edges 438 extending across the fingers 435 in a transverse direction with respect to the elongation direction of the fingers 435. The edges 438 engage the cable 21 to retain the collet 4 on the cable 21. For example, the edges 438 may provide teeth that bite into and engage the outer jacket or surface of the cable 21 to secure the collet 4 to the cable 21 when the fingers 435 are compressed onto the cable 21. Also as shown in the illustrated embodiment, the fingers 435 include raised ribs 440 extending longitudinally along the outer surfaces 437. The ribs 440 define recessed slots 502 longitudinally extending along the outer surfaces 437 of the fingers 435. The fingers 435 are separated from one another by air gaps 504 between the outer edges of the fingers 435. The fingers 435 include inside ramped surfaces 439 and outside ramped surfaces 441 disposed at the outer, or free, ends 500 of the fingers 435. The inside ramped surfaces 439 facilitate assembly of the collet 4 onto the cable 21 (shown in FIG. 2). The outside ramped surfaces 441 cooperate with an inner surface 800 (shown in FIG. 8) of an angled surface 525 (shown in FIG. 7) on the retainer 5 (shown in FIG. 1) to compress the fingers 435 onto the cable 21.

Figure 8:
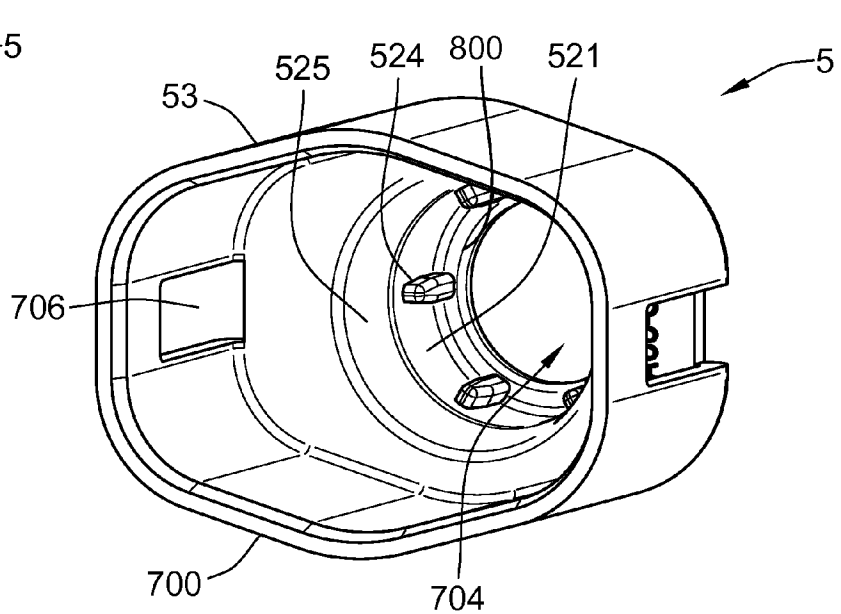
FIG. 8 is a front perspective view of the retainer shown in FIG. 7.
Figure 7:
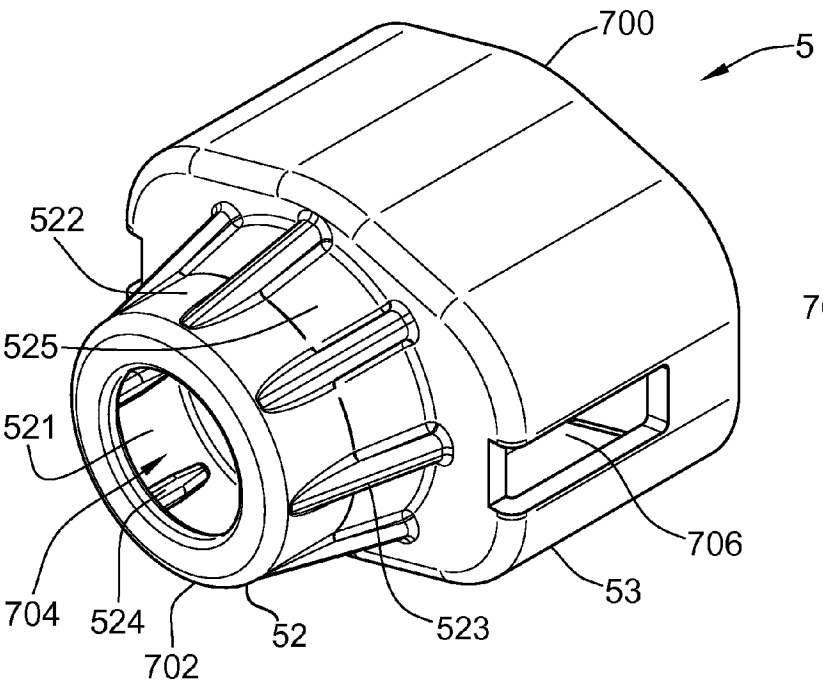
FIG. 7 is a rear perspective view of a retainer for the connector assembly shown in FIG. 1 in accordance with one embodiment.

FIGS. 7 and 8 are perspective views of the retainer 5 in accordance with one embodiment of the present disclosure. The retainer 5 longitudinally extends between a front end 700 and a rear end 702 with an opening 704 extending therethrough. The retainer 5 includes a compression section 52 (shown in FIG. 7) and a shroud section 53. The compression section 52 intersects the shroud section 53 between the front and rear ends 700, 702. In the illustrated embodiment, the compression section 52 extends from the rear end 702 to the shroud section 53 and the shroud section 53 extends from the front end 700 to the compression section 52.

The compression section 52 includes an inner surface 521 and an opposite outer surface 522 (shown in FIG. 7). One or more stiffening ribs 523 that longitudinally extend along the outer surface 522. The ribs 523 add material to the compression section 52 to provide additional strength or stiffness of the compression section 52 against bending or side-to-side flexing. One or more stabilizing ribs 524 longitudinally extend along the inner surface 521 of the compression section 52. The stabilizing ribs 524 engage the fingers 435 (shown in FIG. 5) of the collet 4 (shown in FIG. 3) to stabilize the collet 4. For example, the stabilizing ribs 524 may engage the slots 502 (shown in FIG. 5) and/or be disposed in the air gaps 504 (shown in FIG. 5) to engage the sides of the fingers 435. The engagement between the stabilizing ribs 524 and the fingers 435 may prevent rotation or rotational movement or flexing of the fingers 435 when torsional stress is applied to the cable 21, such as by rotating or twisting the cable 21 (shown in FIG. 2) relative to the collet 4.

The compression section 52 includes a slanted section 525 that has an outer surface 522 and the inner surface 800. The slanted section 525 includes the inner surface 800 that cooperates with the outside ramped surfaces 441 (shown in FIG. 5) of the fingers 435 (shown in FIG. 5) of the collet 4 (shown in FIG. 3) to compress the fingers 435 onto the cable 21 (shown in FIG. 2). For example, the retainer 5 may be positioned over the collet 4 such that the fingers 435 slide from the front to the back along the inner surface 800 and are inwardly biased by the inner surface 800 such that the fingers 435 are compressed onto the cable 21.

The shroud section 53 of the retainer 5 fits over the rear end 102 (shown in FIG. 3) of the outer housing assembly 3 (shown in FIG. 1). In the illustrated embodiment, the shroud section 53 includes openings 706 extending through the shroud section 53. The openings 706 may receive the lugs 311 (shown in FIG. 4) of the outer housing assembly 3 to secure the retainer 5 to the outer housing 31 (shown in FIG. 4) of the outer housing assembly 3. Once secured to the outer housing 31, the retainer 5 encloses the rear end 102 (shown in FIG. 3) of the outer housing 31 to enclose the collet 4 (shown in FIG. 3), the cable seal 42 (shown in FIG. 3), and the spacer 41 (shown in FIG. 3) therein.

Figure 9:
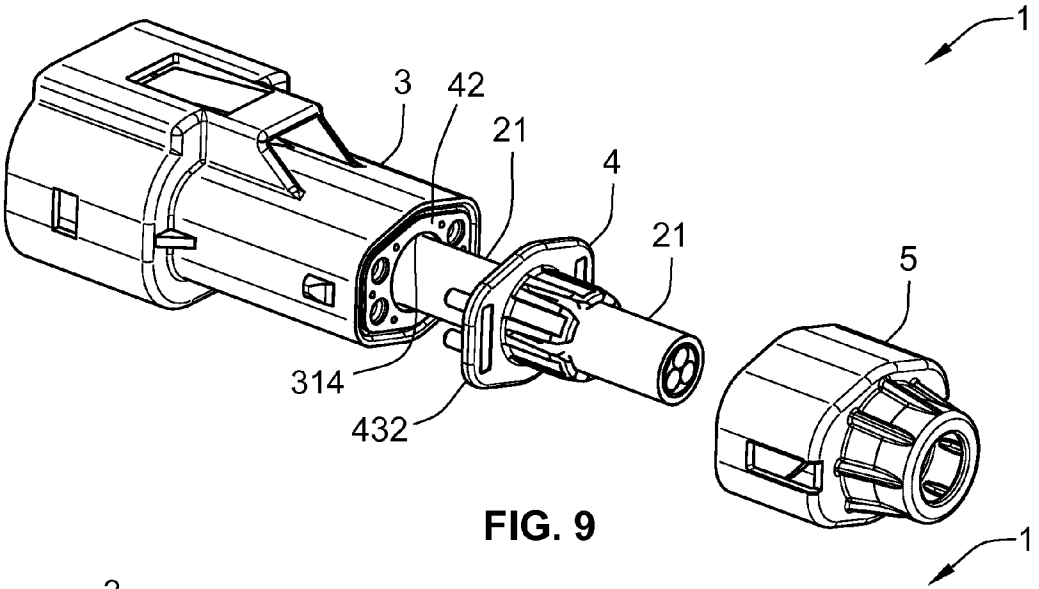
FIG. 9 is a perspective view of a first stage of an assembly sequence of the connector assembly shown in FIG. 1 in accordance with one embodiment.
Figure 10:
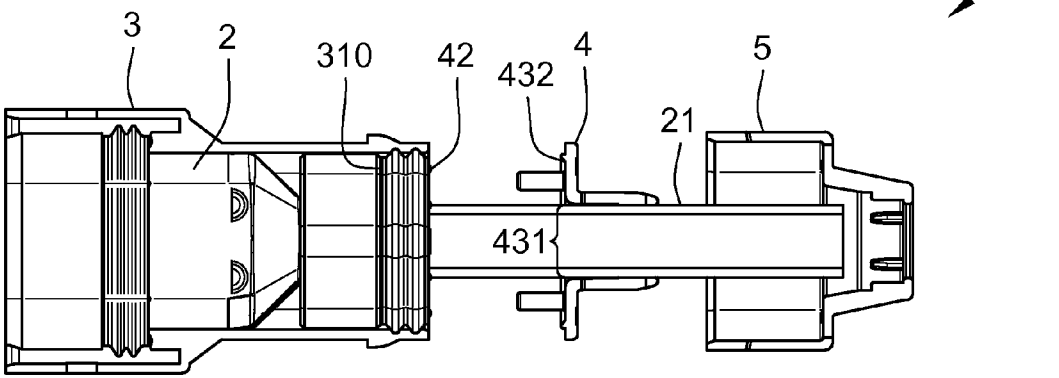
FIG. 10 is a cross-sectional view of the first stage of the assembly sequence for the connector assembly shown in FIG. 9.

FIGS. 9 through 14 illustrate steps of assembling the collet 4 and the retainer 5 to the connector assembly 1 in accordance with one embodiment of the present disclosure. FIG. 9 is a perspective view of the connector assembly 1 in a first stage of assembling the collet 4 and retainer 5 to the connector assembly 1. FIG. 10 is a cross-sectional view of the connector assembly 1 shown in FIG. 9. The inner subassembly 2 is placed within the outer subassembly 3. In the first stage, the cable 21 is slid through the opening 314 of the cable seal 42 from the front side 310 of the cable seal 42 and the central opening 431 of the collet 4 from the front side 432 of the collet 4.

Figure 11:
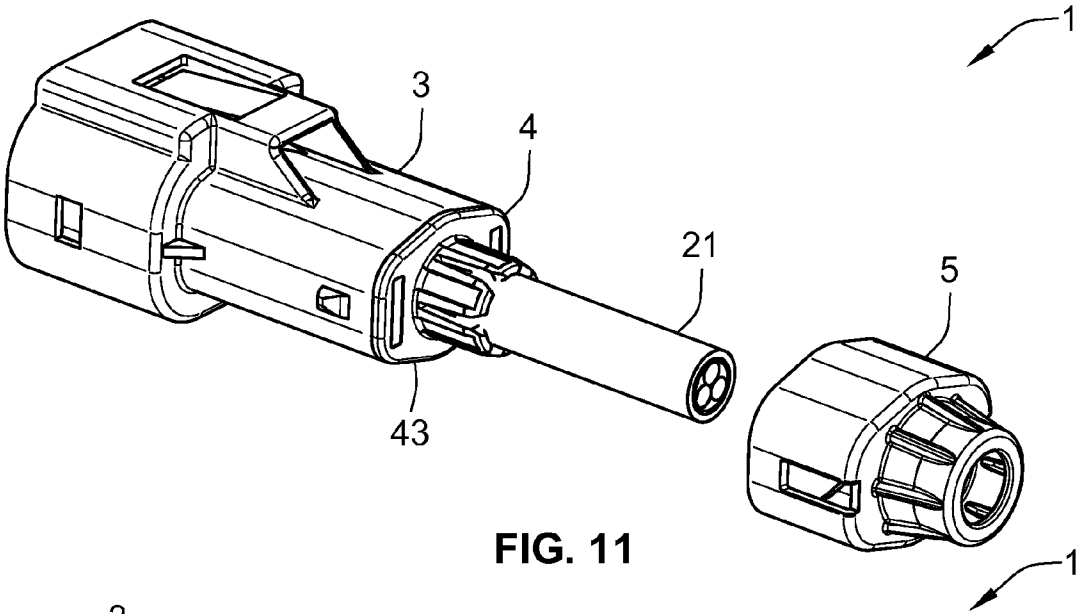
FIG. 11 is a perspective view of a second stage of an assembly sequence of the connector assembly shown in FIG. 1 in accordance with one embodiment.
Figure 12:
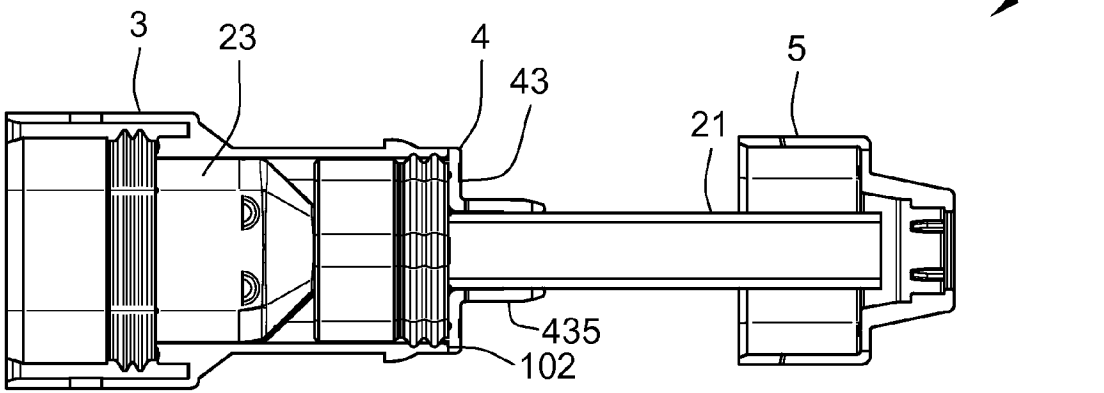
FIG. 12 is a cross-sectional view of the second stage of the assembly sequence for the connector assembly shown in FIG. 11.

FIG. 11 is a perspective view of the connector assembly 1 in a second stage of assembling the collet 4 and retainer 5 to the connector assembly 1. FIG. 12 is a cross-sectional view of the connector assembly 1 shown in FIG. 11. In the second stage, the collet 4 is moved or slid toward the outer housing subassembly 3 until the posts 434 (shown in FIG. 5) of the collet 4 are received into the corresponding openings 316 (shown in FIG. 3) in the cable seal 42. The body 43 of the collet 4 mates with the rear end 102 of the outer housing subassembly 3. As shown in FIG. 12, the collet 4 mates with the rear end 102 to enclose the cable seal 42, the spacer 41, the shields 23, 24 (shown in FIG. 4), and the inner housing 22 (shown in FIG. 4) in the outer housing subassembly 3. Although not shown in FIG. 12, the fingers 435 of the collet 4 may be outwardly biased away from one another and the cable 21 in the second stage of assembly.

Figure 13:
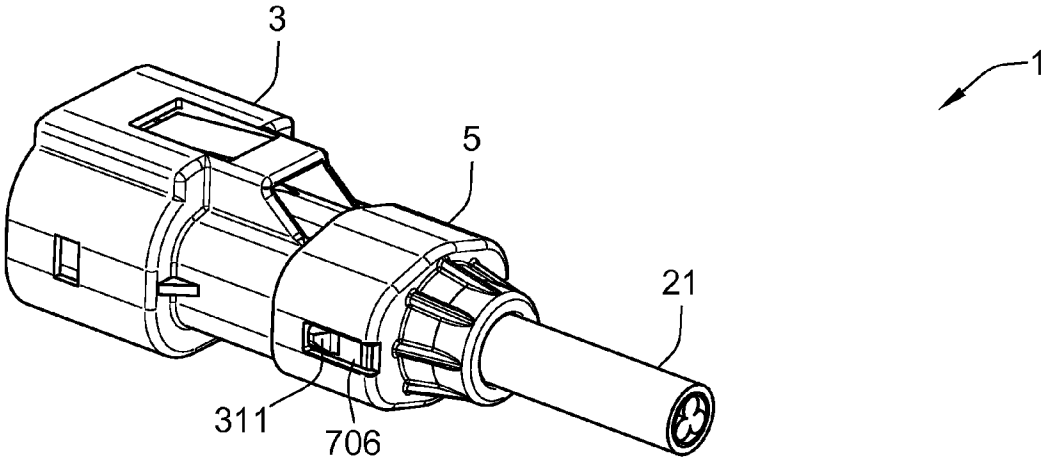
FIG. 13 is a perspective view of a third stage of an assembly sequence of the connector assembly shown in FIG. 1 in accordance with one embodiment.
Figure 14:
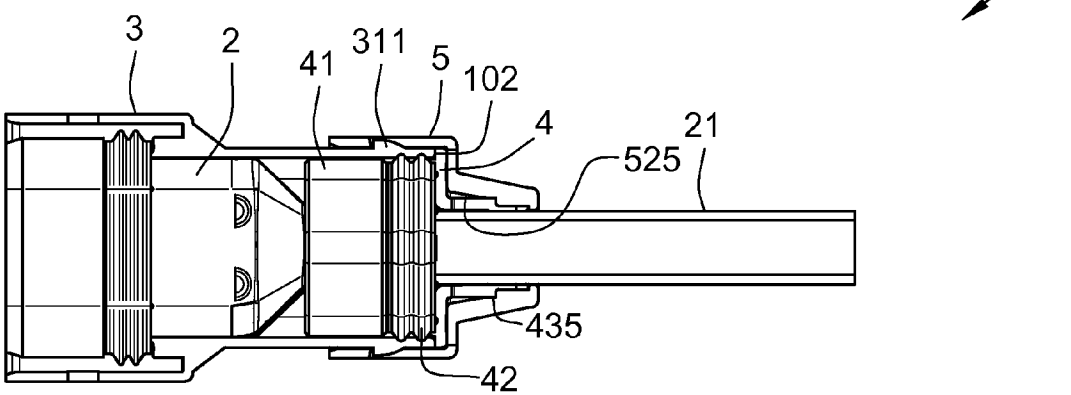
FIG. 14 is a cross-sectional view of the third stage of the assembly sequence for the connector assembly shown in FIG. 13.

FIG. 13 is a perspective view of the connector assembly 1 in a third stage of assembling the collet 4 and retainer 5 to the connector assembly 1. FIG. 14 is a cross-sectional view of the connector assembly 1 shown in FIG. 13. The third stage of assembling the connector assembly 1 may be the final stage of assembly. In the third stage, the retainer 5 is slid over the cable 21 and the collet 4. As the retainer 5 slides over the collet 4, the stabilizing ribs 524 (shown in FIG. 7) of the retainer 5 may be positioned between the ribs 440 (shown in FIG. 5) on the fingers 435 of the collet 4, or within the slots 502 (shown in FIG. 5) defined by the ribs 440. Alternatively, the stabilizing ribs 524 may be disposed between the fingers 435 within the air gaps 504 (shown in FIG. 5). The inner surface 800 of the retainer 5 moves relative to and over the fingers 435 of the collet 4 to pass the collet 4 onto the cable 21. The slanted surface 525 inwardly biases the fingers 435 toward one another such that the fingers 435 are compressed onto the cable 21. The fingers 435 may be compressed onto the cable 21 such that the serrated edges 438 (shown in FIG. 6) of the fingers 435 engage the cable 21 to secure the collet 4 to the cable 21.

The openings 706 in the retainer 5 accept the lugs 311 of the outer housing subassembly 3 to secure the retainer 5 to the rear end 102 of the outer housing subassembly 3. The retainer 5 encloses the collet 4, the cable seal 42, the spacer 41, and the inner housing subassembly 2 within the outer housing subassembly 3 while permitting the cable 21 to rearwardly extend and protrude through the retainer 5.

In one embodiment, once the retainer 5 is secured to the outer housing subassembly 3, movement of the cable 21 outside of and relative to the connector assembly 1 may result in strain being imparted on interfaces between the cable 21 and one or more other components of the connector assembly 1. For example, movement of the cable 21 outside of the connector assembly 1 may impart a strain at interfaces between the cable 21 and components to which the cable 21 is joined. Instead of the strain being applied to the interface between the cable 21 and the shields 23, 24 (shown in FIG. 4) of the inner housing subassembly 2, the collet 4 and/or retainer 5 may restrict movement of the cable 21 outside of and away from the interface between the cable 21 and the shields 23, 24 to redirect the strain away from the interface. For example, the portion of the cable 21 that is outside of the connector assembly 1 is permitted to be moved relative to the connector assembly 1 while the portion of the cable 21 that is located within the connector assembly 1 between the compression section 52 of the retainer 5 and the shields 23, 24 is restricted from movement relative to the connector assembly 1. As a result, the strain imparted at interfaces between the cable 21 and other components of the connector assembly 1 is isolated away from the inner housing subassembly 2 and the shields 23, 24 and may be redirected to the relatively stiff collet 4 and/or the retainer 5, where the strain may not cause separation of the cable 21 from the connector assembly 1.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §1102, sixth paragraph, unless and until such claim limitations expressly use the phrase "means for" followed by a statement of function void of further structure.

What is claimed is:

1. A connector assembly comprising:

an outer housing longitudinally extending between a front end and a rear end, the rear end having an opening for receiving a cable;

an inner housing located within the outer housing;

an electromagnetic shield for shielding the inner housing, the electromagnetic shield configured to be electrically coupled with the cable at an interface;

a collet disposed around the cable at the rear end of the outer housing, the collet including longitudinally extending fingers configured to engage the cable; and a cable seal retainer secured to the rear end of the outer housing, the cable seal retainer securing the collet between the outer housing and the cable seal retainer, wherein the cable seal retainer and the collet redirect strain imparted on the cable away from the interface between the shield and the cable.

2. The connector assembly of claim 1, wherein the fingers of the collet include serrated inner edges that engage and secure the collet to the cable.

3. The connector assembly of claim 1, further comprising a cable seal disposed at the rear end of the outer housing between the outer housing and the collet, the cable seal compressed by the collet and sealing the rear end of the outer housing.

4. The connector assembly of claim 1, wherein the fingers outwardly flex when the cable is loaded into the collet between the fingers.

5. The connector assembly of claim 1, wherein the retainer compresses the fingers of the collet onto the cable, the retainer having a shroud section that fits over the rear end, the retainer being secured to the outer housing thereby enclosing the rear end.

6. The connector assembly of claim 1, wherein the collet includes a planar body having an opening extending therethrough that is sized to receive the cable, wherein the planar body has a front side that faces an interior of the outer housing and a rear side that faces away from the interior of the outer housing, the fingers extending from the rear side of the planar body.

7. The connector assembly of claim 6, further comprising a cable seal disposed in the rear end of the outer housing, wherein the fingers engage the cable protruding on one side of the planar body and the collet includes projections that engage the cable seal protruding from an opposite side of the planar body.

8. The connector assembly of claim 1, wherein the electromagnetic shield is configured to be mechanically secured to the cable at the interface, the electromagnetic shield being restricted from moving relative to the cable within the outer housing.

9. The connector assembly of claim 8, wherein the electromagnetic shield extends from the interface and substantially encloses the inner housing.

10. The connector assembly of claim 8, wherein the electromagnetic shield comprises first and second shields that are combined to substantially enclose the inner housing therebetween.

11. A connector assembly comprising:

an outer housing longitudinally extending between a front end and a rear end, the rear end having an opening for receiving a cable;

an inner housing located within the outer housing, the inner housing having a shield that electrically couples with the cable to restrict emission of electromagnetic interference;

a collet disposed around the cable at the rear end of the outer housing, the collet including longitudinally extending fingers configured to engage the cable;

a cable seal retainer secured to the rear end of the outer housing, the cable seal retainer securing the collet between the outer housing and the cable seal retainer, wherein the cable seal retainer and the collet redirect strain imparted on the cable away from an interface between the shield and the cable; and a cable seal disposed at the rear end of the outer housing between the outer housing and the collet, the cable seal compressed by the collet and sealing the rear end of the outer housing;

wherein the cable seal comprises an elastomeric body having a cable opening extending therethrough to receive the cable and inwardly extending post openings, the collet including forwardly protruding posts that are received into the post openings of the cable seal.

12. A connector assembly comprising:

an outer housing subassembly extending between a front end and a rear end;

a cable extending from the rear end of the outer housing subassembly;

a collet secured to the cable at the rear end of the outer housing subassembly, the collet having an opening through which the cable extends, wherein the collet comprises fingers that secure the collet to the cable; and a cable seal disposed within the rear end of the outer housing subassembly, the cable seal having a cable opening through which the cable extends and projection openings, wherein the collet includes forwardly protruding projections that are received into the projection openings.

13. The connector assembly of claim 12, wherein further comprising a retainer that deflects the fingers into the cable, the collet and the retainer reducing strain imparted on the cable.

14. The connector assembly of claim 12, further comprising a retainer that deflects the fingers into the cable, the collet and the retainer reducing strain imparted on the cable, wherein the outer housing subassembly comprises outwardly protruding lugs that secure the retainer to the rear end of the outer housing subassembly, the retainer having a shroud section that fits over the rear end, the retainer being secured to the outer housing subassembly thereby enclosing the rear end.

15. The connector assembly of claim 12, further comprising a retainer, wherein the fingers are rearwardly projecting, the retainer securing the collet to the cable by engaging the fingers and compressing the fingers onto the cable.

16. A connector assembly comprising:

an outer housing subassembly extending between a front end and a rear end;

a cable extending from the rear end of the outer housing subassembly;

a collet secured to the cable at the rear end of the outer housing subassembly, the collet having an opening through which the cable extends, wherein the collet comprises fingers that secure the collet to the cable;

an inner housing subassembly having an inner housing interconnected with the cable and an electromagnetic shield that receives the cable, the electromagnetic shield being electrically coupled to the cable; and a retainer surrounding the collet and secured to the outer housing subassembly, wherein the collet and the retainer reduce strain imparted on the cable.

17. The connector assembly of claim 16, wherein the collet redirects the strain imparted on the cable away from an interface between the cable and the electromagnetic shield such that a portion of the cable from the interface to where the collet is secured to the cable is restricted from movement relative to the outer housing subassembly.

18. The connector assembly of claim 16, wherein the cable has an outer jacket and a cable shield surrounded by the outer jacket, the electromagnetic shield being mechanically secured to the cable shield at an interface, the electromagnetic shield being restricted from moving relative to the cable within the outer housing assembly.

19. The connector assembly of claim 18 further comprising at least one ferrule that is used to mechanically secure the electromagnetic shield to the cable shield.

20. The connector assembly of claim 16, wherein the electromagnetic shield comprises first and second shields that are combined to substantially enclose the inner housing therebetween.

* * * * *